US010335821B2

(12) United States Patent
Schneider

(10) Patent No.: US 10,335,821 B2
(45) Date of Patent: Jul. 2, 2019

(54) ACCESSIBLE HOUSING DEVICE

(71) Applicant: Gary Nicholas Schneider, Land O lakes, FL (US)

(72) Inventor: Gary Nicholas Schneider, Land O lakes, FL (US)

( * ) Notice: Subject to any disclaimer, the term of this patent is extended or adjusted under 35 U.S.C. 154(b) by 135 days.

(21) Appl. No.: 15/203,065

(22) Filed: Jul. 6, 2016

(65) Prior Publication Data

US 2017/0095826 A1 Apr. 6, 2017

Related U.S. Application Data

(60) Provisional application No. 62/284,585, filed on Oct. 5, 2015.

(51) Int. Cl.

| | |
|---|---|
| ***B05B 15/00*** | (2018.01) |
| ***B05B 15/16*** | (2018.01) |
| ***B05B 15/70*** | (2018.01) |
| ***B05B 15/658*** | (2018.01) |
| ***B05B 15/74*** | (2018.01) |

(52) U.S. Cl.

CPC ..... *B05B 15/16* (2018.02); *B05B 15/658* (2018.02); *B05B 15/70* (2018.02); *B05B 15/74* (2018.02)

(58) Field of Classification Search

CPC ..... B05B 15/62; B05B 15/622; B05B 15/625; B05B 15/16; B05B 15/14; B05B 15/70

USPC ..... 239/200, 201, 203, 288, 288.3, 288.5

See application file for complete search history.

(56) References Cited

U.S. PATENT DOCUMENTS

| | | | | |
|---|---|---|---|---|
| 3,265,310 | A | 8/1966 | Cohen | |
| 4,145,003 | A | 3/1979 | Harrison | |
| 4,212,426 | A | 7/1980 | Choi | |
| 4,350,296 | A * | 9/1982 | Kuhlman | A01G 25/06 239/201 |
| 5,938,121 | A | 8/1999 | Ferguson | |
| 6,494,386 | B1 | 12/2002 | Banu | |
| 6,712,086 | B1 * | 3/2004 | Fails | E03B 7/072 137/15.03 |
| 6,764,025 | B1 | 7/2004 | Espina | |
| 7,617,994 | B2 | 11/2009 | Gunderson | |
| 7,717,360 | B1 * | 5/2010 | Kander | B05B 15/16 239/208 |
| 8,550,375 | B2 | 10/2013 | Curtis | |

(Continued)

*Primary Examiner* — Alexander M Valvis
*Assistant Examiner* — Tuongminh N Pham
(74) *Attorney, Agent, or Firm* — Mitchell Intellectual Property Law, PLLC

(57) ABSTRACT

An accessible housing device (FIGS. 1 and 1A—200) of one embodiment that provides a housing body (FIG. 2—60) for housing a pop-up sprinkler assembly FIG. 1—140, and the immediate connectors FIGS. 1 and 1A—93, —95, and —96, and a plurality of cutouts (FIG. 2—69) in a bottom section (FIG. 2—62) for permitting an entrance to multiple incoming water feed lines simultaneously, a housing cover (FIG. 3—18) comprising a plurality of fingers (FIG. 3—16), for enclosing and positioning various pop-up sprinkler assemblies having individually sized outer diameters, and additionally comprising a retaining lip (FIG. 3—35) for housing a safety cover (FIG. 4—97), for diminishing liability concerns and recognition purposes, an offset insert (FIG. 5—100) comprising a plurality of offset fingers (FIG. 5—103), for enclosing and positioning a flexible riser pipe when an offset of the housing body (—60) is necessary.

10 Claims, 15 Drawing Sheets

(56) References Cited

U.S. PATENT DOCUMENTS

| | | | | |
|---|---|---|---|---|
| 8,684,322 | B2 | 4/2014 | Park | |
| 8,936,206 | B1 | 1/2015 | Wright | |
| 2008/0296406 | A1* | 12/2008 | Gauthier, III ..... | A01G 13/0281 239/288.5 |
| 2009/0084869 | A1* | 4/2009 | Lin ..... | B05B 15/16 239/201 |
| 2009/0277974 | A1 | 11/2009 | Citrawireja | |
| 2012/0325931 | A1 | 12/2012 | Croser | |

* cited by examiner

ACCESSIBLE HOUSING DEVICE

CROSS-REFERENCE TO RELATED APPLICATIONS

This application claims the benefit of provisional patent application Ser. No. 62/284,585, filed Oct. 5, 2015, by the present inventor.

BACKGROUND

PRIOR ART

The following is a tabulation of some prior art that presently appears relevant:

| U.S. Patents | | | |
|---|---|---|---|
| Patent Number | Kind Code | Issue Date | Patentee |
| 7,617,994 | B2 | 2009 Nov. 17 | Gunderson |
| 6,764,025 | B1 | 2004 Jul. 20 | Espina |
| 5,938,121 | A | 1999 Aug. 17 | Ferguson |
| 8,936,206 | B1 | 2015 Jan. 20 | Wright |
| 6,494,386 | B1 | 2002 Dec. 17 | Banu |
| 3,265,310 | A | 1966 Aug. 9 | Cohen |

Traditionally a pop-up sprinkler assembly and the immediate connectors have been buried in the ground. Today this practice continues despite the fact that the surrounding elements, such as sand, dirt, grass, and the like, constantly cause operational problems. In addition, these same elements must be removed, usually by the manual process of digging, when the pop-up sprinkler assembly and the immediate connectors need a repair, and/or a replacement. Today several types of a housing device, in related U.S. Prior Art Patents, have been created for isolating, and protecting the pop-up sprinkler assembly within the lawn area. These housing devices however are not without their individual, and/or grouped problems. The problems include though are not limited to; accessing the pop-up sprinkler assembly and the immediate connectors without including the need for digging; enclosing and positioning various pop-up sprinkler assemblies having individually sized outer diameters for placement, and function within the housing device; and providing a low cost reliable product to an end-user/purchaser. Today most of the housing devices in related prior art, have resolved the problem of having to dig to access the pop-up sprinkler assembly itself, except in U.S. Pat. No. 7,617,994, Gunderson 2009 Nov. 17, wherein the top housing cap after installation is recovered with either an artificial turf or a real grass. The artificial turf may support Gunderson's statement within the issued patent; that this device and method avoids digging and dirt. Though covering the top housing cap with the real grass, would require a certain amount of digging to access the top housing cap, and the sprinkler assembly whenever a problem develops. The real grass would require some type of a soil or the like, comprised within its root system for providing nutrients, and promoting a re-growth. The real grass without these necessary elements would wither and die. The problem of accessing the immediate connectors buried beneath the housing device is virtually unaddressed in most related prior art patents. Though it is well known in the art that stripped threads of bottom connectors, and broken riser pipes resulting from the sprinkler assembly being struck by a lawnmower wheel or another means are common occurrences.

PRIOR ART

A limited exception of this issue is in U.S. Pat. No. 6,494,386 Banu, 2002 Dec. 17, wherein the patent discloses a housing device, with an alternative form of construction, having an outlet in a wall for allowing the water feed line to pass through. The water feed line supplies water to the sprinkler assembly, via the riser pipe, and the bottom connector. The problem with this embodiment is that only a single outlet is disclosed, which would work unless the bottom connector is designed for multiple applications of the water feed line, such as a T connector. The T connector has two slip joints positioned at opposite ends for connecting to two water feed lines, and a centrally positioned vertical threaded joint for connecting to the rise pipe. Forthcoming are examples of prior art housing devices that do not allow total access to the immediate connectors buried beneath the housing, such as the bottom connector or fitting. U.S. Pat. No. 7,617,994, Gunderson 2009 Nov. 17, discloses a bottom housing cap that allows the riser pipe to pass through, however total access to the other connectors buried beneath the housing is not permitted, since the bottom housing cap closes off that area, and only allows an entry for the riser pipe, and the vertical threaded portion of the bottom connector. U.S. Pat. No. 6,764,025, Espina 2004 Jul. 20, discloses a tubular chamber that is screwed onto an underground threaded pipe. The tubular chamber has a lower threaded opening located in the central axis for cooperatively receiving the lower threaded end of the riser pipe. The tubular chamber however has a base wall, so again the connectors buried beneath the housing device are not accessible. U.S. Pat. No. 5,938,121, Ferguson 1999 Aug. 17, discloses a base sleeve with a bottom base plate having a fluid conveyance, that is threaded into the bottom connector, and into a sprinkler shaft, (the riser pipe). The bottom base plate however only allows the fluid conveyance between the two devices, and not access to the connectors buried beneath the housing device. U.S. Pat. No. 8,936,206, Wright 2015 Jan. 20, discloses a bottom sleeve that houses a bottom seal. The bottom seal provides a snug fit for the sprinkler assembly and keeps elements from traveling up into the bottom sleeve.

Again, though access to the connectors buried beneath the housing device is not permitted. The foregoing four prior art housing devices, would require their removal from the ground in order to properly address an issue arising from stripped threads, or another like issue, which in turn would require a certain amount of digging.

The problem of enclosing and positioning various pop-up sprinkler assemblies having individually sized outer diameters, has been approached in numerous ways by many related prior art patents. For example, U.S. Pat. No. 7,617,994, Gunderson 2009 Nov. 17, discloses circular punch-outs in a top housing cap for addressing this issue, but the results of that solution seem to be limited. Since the forethought of a user wanting to change sprinkler assemblies having individually sized outer diameters, in a particular housing device, was not adequately taken into consideration. A proposed example of is; the user has punched out a large circular hole in the top housing cap for enclosing a sprinkler assembly having a large outer diameter. The user later decides to change the large sprinkler assembly to a smaller sprinkler assembly having a smaller outer diameter. The top housing cap, after having the large circular section punched out for accommodating the large sprinkler assembly, would not properly enclose or position the smaller sprinkler assembly. The patent does not state in any manner, that the circular punch-outs can be re-attached. This possible proposed application, or its equivalent, would render this particular top housing cap useless to the user under these circumstances. U.S. Pat. No. 6,494,386, Banu 2002 Dec. 17, discloses a plurality of first and second brackets having a first and second diameter, positioned within an inner support of a top for addressing this issue. The brackets are removed by snapping them off to enclose and position a particular sprinkler assembly. However, the forethought proposed in U.S. Pat. No. 7,617,994 Gunderson seems to apply again. For example, the user has snapped off a section of the brackets for accommodating a sprinkler assembly having a large outer diameter. The user later decides to change the large sprinkler assembly to a sprinkler assembly having a smaller outer diameter.

PRIOR ART

The remaining brackets present within the inner support of the top, after snapping off the required brackets for accommodating the large sprinkler assembly, would have an inner dimension too large for properly enclosing, and positioning the smaller sprinkler assembly. Again, the patent does not state in any manner, that the removed brackets of the housing device can be re-attached. This possible proposed application, or its equivalent, would also render this particular housing cap useless to the user under these circumstances.

In addition, if the above two proposed applications were applied by the user unknowingly, or regardless as to their ending consequences, the surrounding soil, and/or elements, would eventually enter into the housing devices. An entry vehicle for the soil could be a hard rain, and an entry mode for the vehicle, would be the open areas around the sprinkler assembly where it would not be properly enclosed. Further, the above two referenced prior art patents, with their proposed individual circumstances, would necessitate a purchase of new replacement parts, and the cost of those items would be passed on, and/or absorbed by the end-user/purchaser. U.S. Pat. No. 3,265,310, Cohen 1966 Aug. 9, discloses a base portion that is buried in the ground. The base portion has a covering hooded portion with a central bore, for housing the pop-up sprinkler assembly. However, there is no mention that the central bore would enclose sprinkler assemblies having individually sized outer diameters. In this case, I presume the time period of the patent issue date, would reveal that there was not such a variety of pop-up sprinkler assemblies having individually sized outer diameters. Today the related market offers a wide range of pop-up sprinkler assemblies having individually sized outer diameters, and in so saying this particular housing device would be considered antique.

Therefore, I am confident that a person with ordinary skill in the art, would recognize the apparent disadvantages comprised within these prior art housing devices, and realize the need for an accessible housing device that resolves the above disadvantages, by providing features that greatly diminish consequential options, and/or limiting results for the end-user/purchaser.

ADVANTAGES

Thus, several advantages of one or more aspects are to provide an accessible housing device;

that includes sufficient space within an inner cavity for housing a pop-up sprinkler assembly, and the immediate connectors, that allows a human being to access the housed devices without the need for digging, which provides the benefit of spending less time for doing a repair, and/or a replacement, that separates the surrounding elements such as sand, dirt, grass, and the like, from the housed devices for diminishing their operational problems, that encloses and positions various pop-up sprinkler assemblies having individually sized outer diameters, by applying inward pressure against their outer body covers, that encloses and positions a flexible riser pipe in the same above manner, when an offset of the housing device is necessary to house the pop-up sprinkler assembly, that comprises a safety feature, for reducing possible concerns of personal injury to children or other persons, and in addition includes a recognition feature, for identifying the location area of the housing device in a lawn area, that includes entrances in a bottom section for accommodating multiple incoming water feed lines simultaneously, that provides future savings for consumers on labor cost, when a device is to be removed for the repair, and/or the replacement by a skilled artisan, that can be installed close to a ground level, for giving an option to the user of using minimal lawn cutting machinery, that is easily installed, and then after that installation its appearance is uniform, attractive, and in plain view for consumers, and lawn service providers, that is inexpensive to manufacture.

These and other advantages of one or more aspects will become apparent from a consideration of the ensuing description and accompanying drawings.

SUMMARY

An accessible housing device of one embodiment with one or more aspects that provides an inner cavity of sufficient size for housing a pop-up sprinkler assembly, and the immediate connectors, and that provides enclosing, and positioning accommodations for various pop-up sprinkler assemblies having individually sized outer diameters in different installation situations, and for a flexible riser pipe in an offset installation situation.

DRAWINGS

Figure 7:
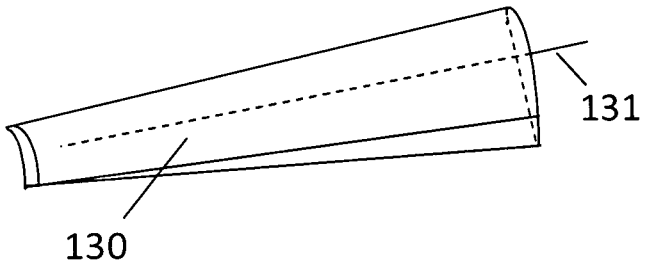
Figure 7A:
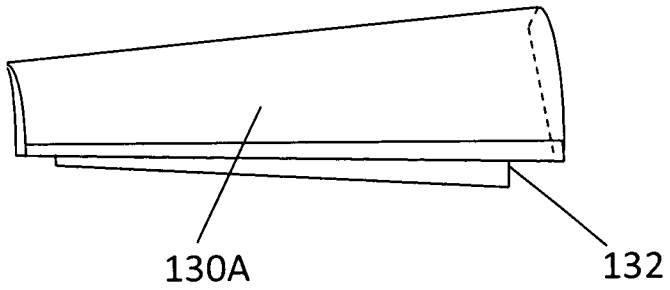
Figure 7B:
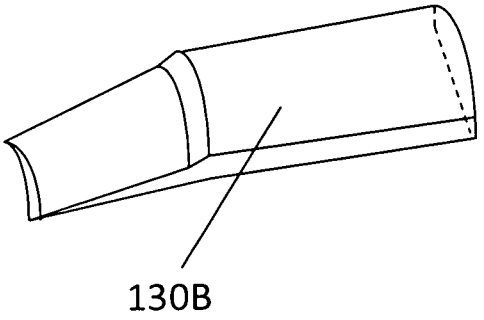
Figure 8:
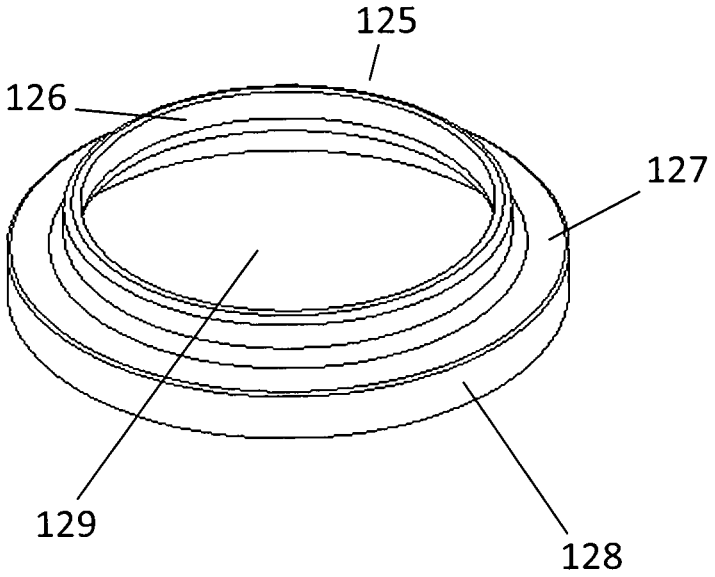

FIGS. 7, 7A, and 7B are perspective views of one or more alternative embodiments of my invention FIG. 8 is a perspective view of an alternative embodiment of my invention.

Figure 9:
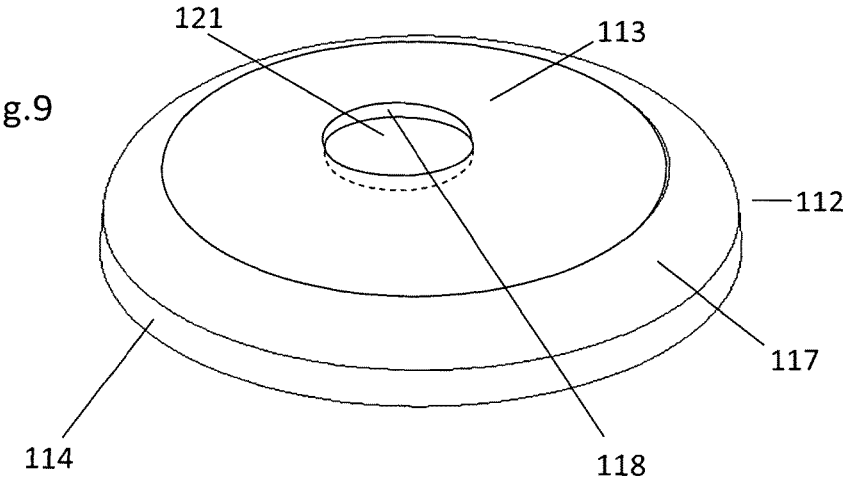

FIG. 9 is a perspective view of an alternative embodiment of my invention.

Figure 9A:
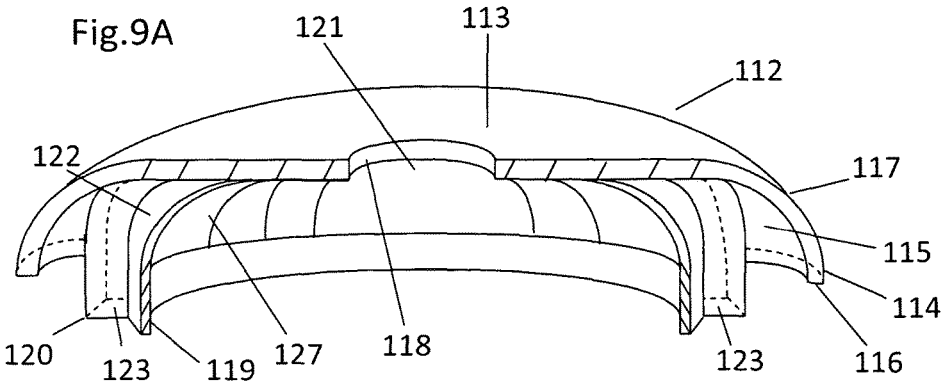

FIG. 9A is a detailed cutaway view of an alternative embodiment of my invention.

Figure 10:
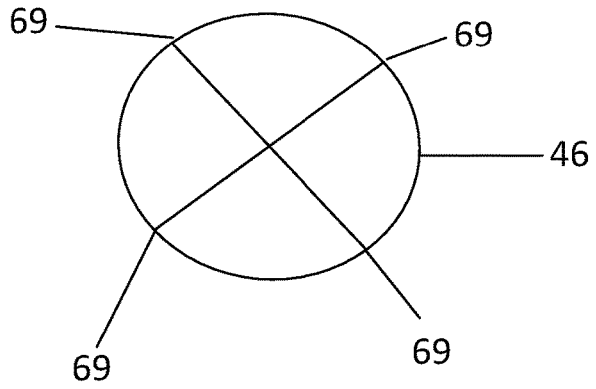
Figure 10A:
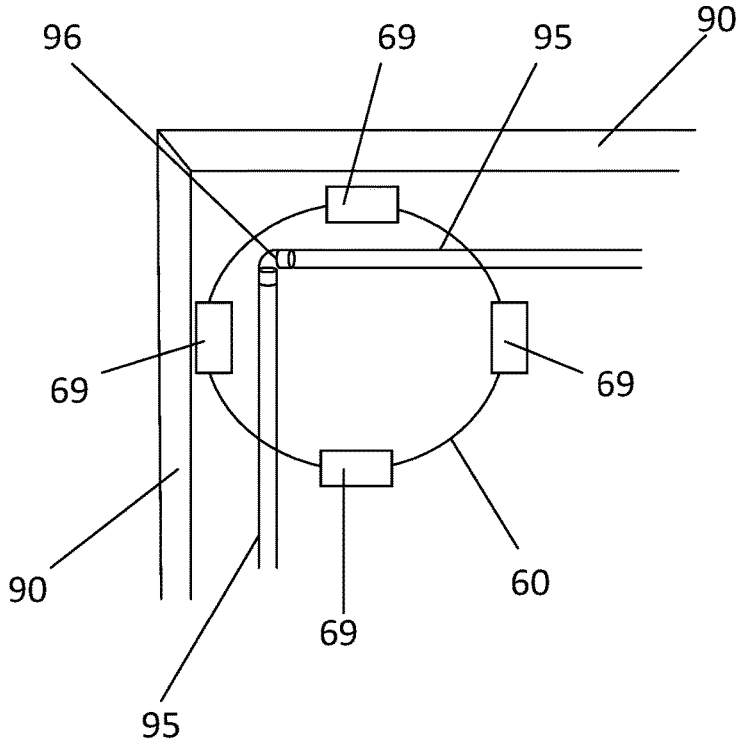

FIGS. 10 and 10A are overhead views of a first embodiment of my invention.

Figure 11:
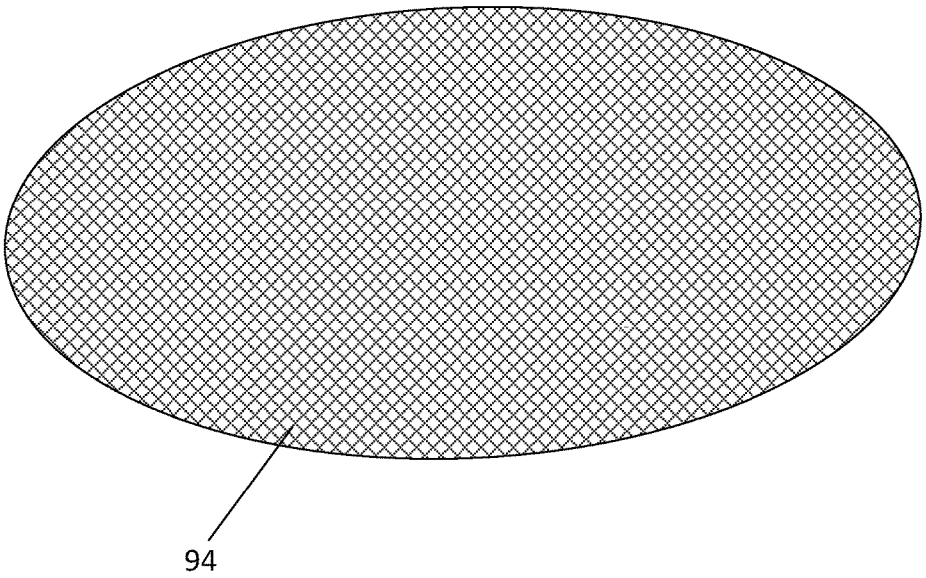

FIG. 11 is a side view of a first embodiment of my invention.

Figure 11A:
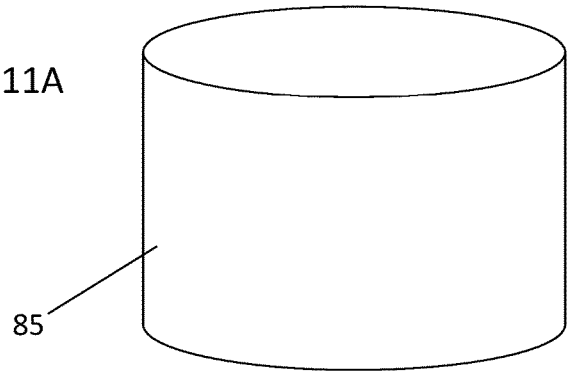

FIG. 11A is a perspective view of an alternative embodiment of my invention.

DRAWINGS—LIST OF REFERENCE NUMERALS

Figure 1:
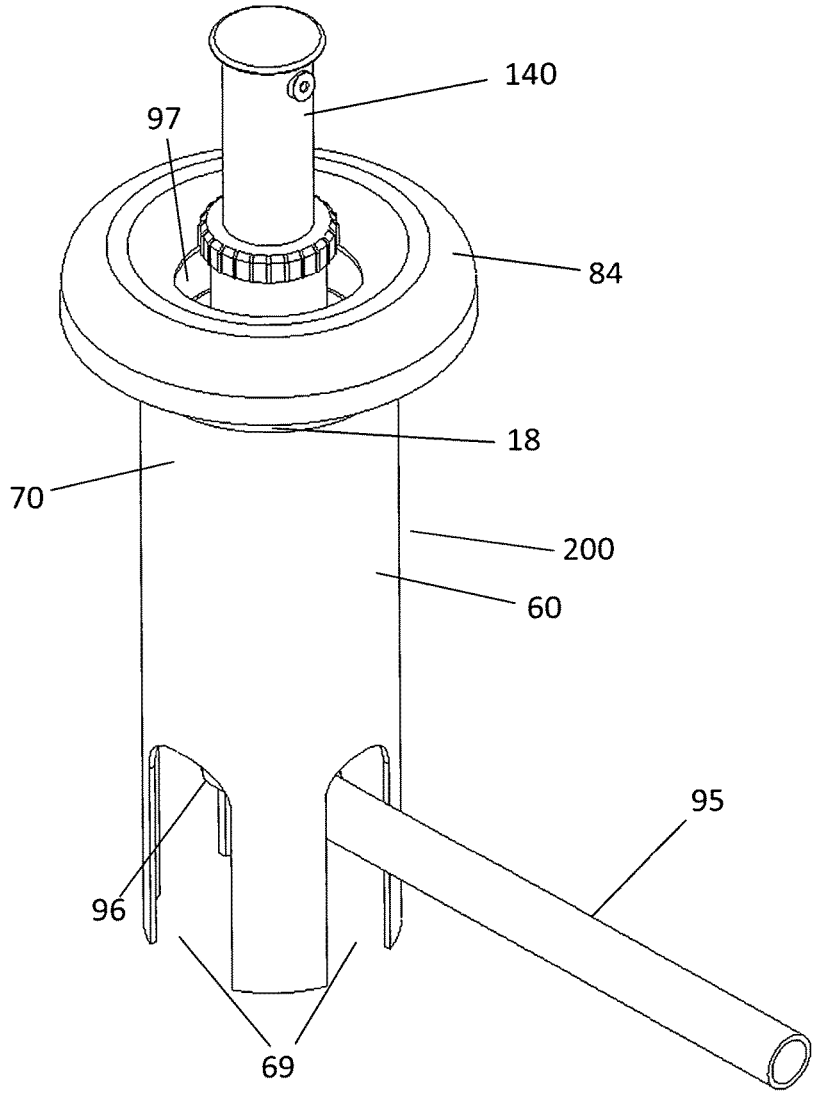
FIG. 1 is a perspective view of a first embodiment of my invention.
Figure 1A:
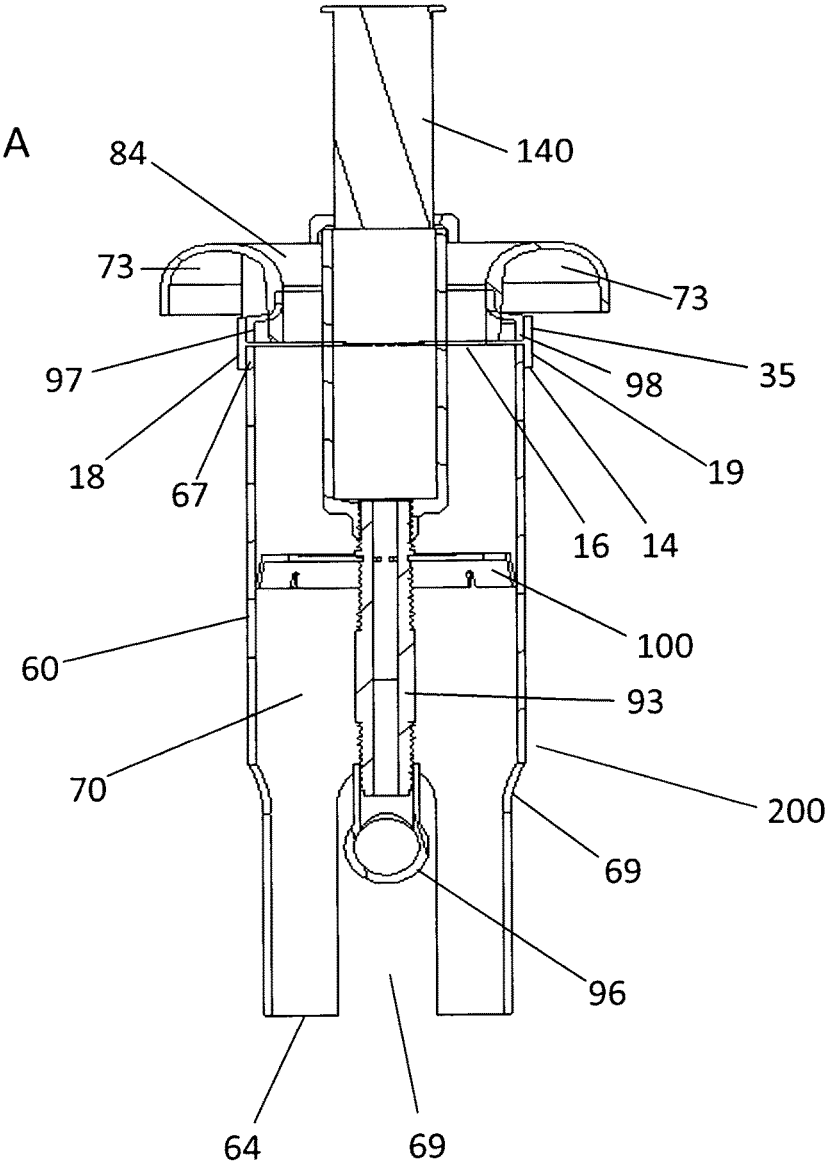
FIG. 1A is a detailed cutaway view of a first embodiment of my invention.
Figure 2:
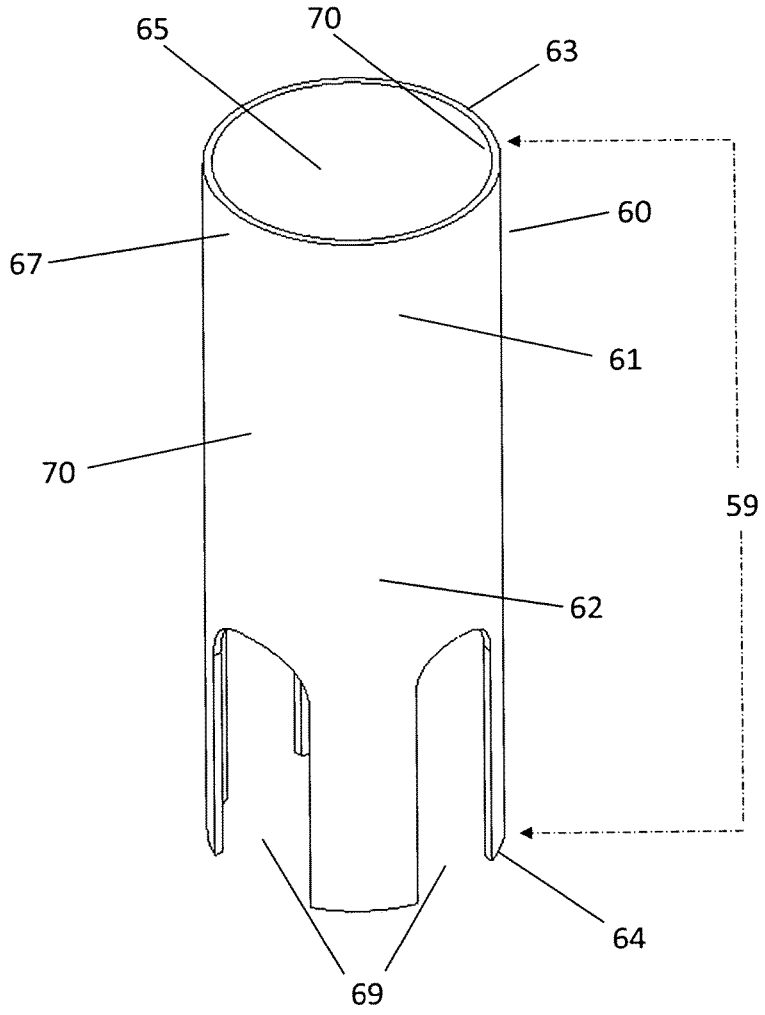
FIG. 2 is a perspective view of a first embodiment of my invention.
Figure 3:
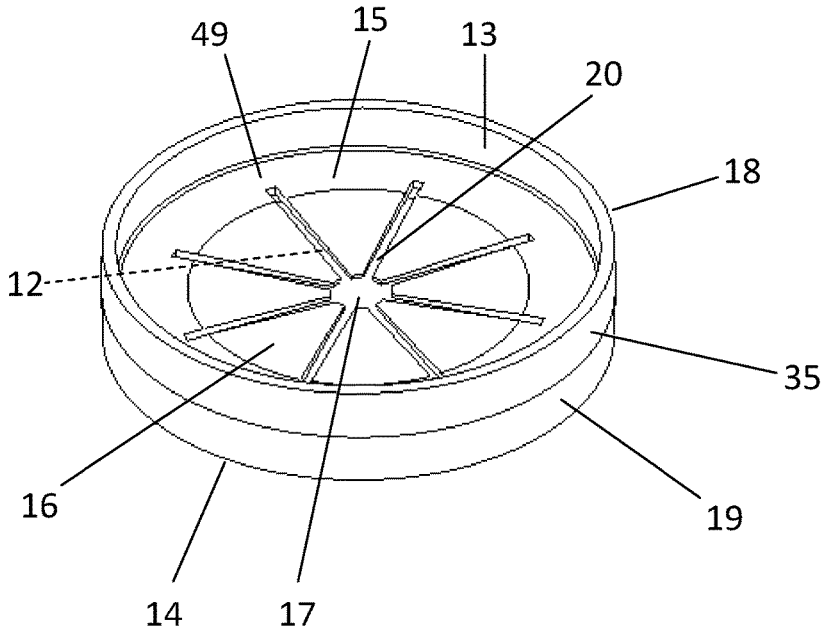
FIG. 3 is a perspective view of a first embodiment of my invention.
Figure 4:
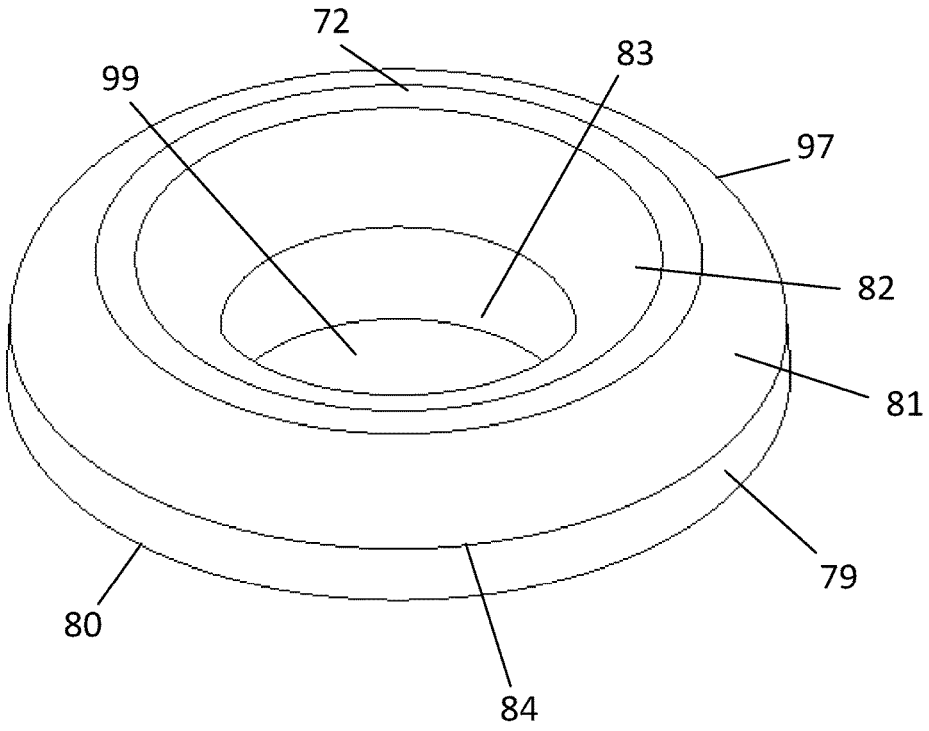
FIG. 4 is a perspective view of a first embodiment of my invention.
Figure 4A:
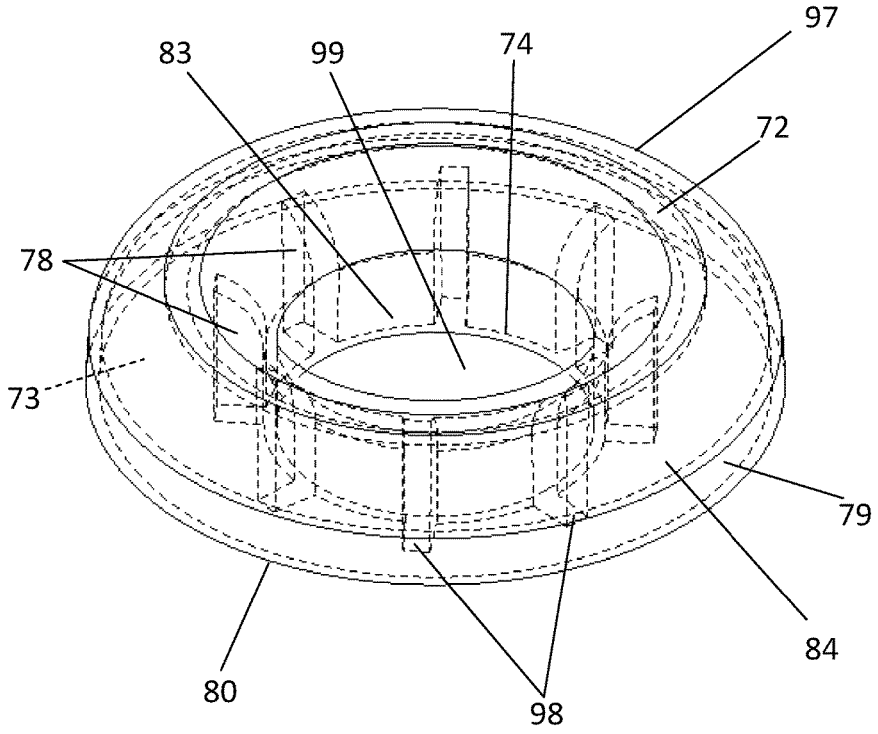
FIG. 4A is a 3-dimensional view of a first embodiment of my invention.
Figure 4B:
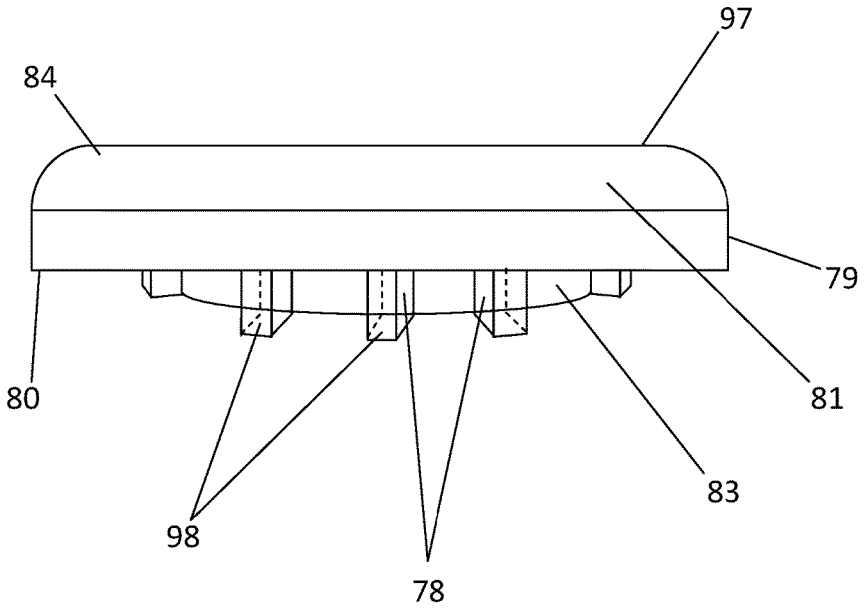
FIG. 4B is a side view of a first embodiment of my invention.
Figure 5:
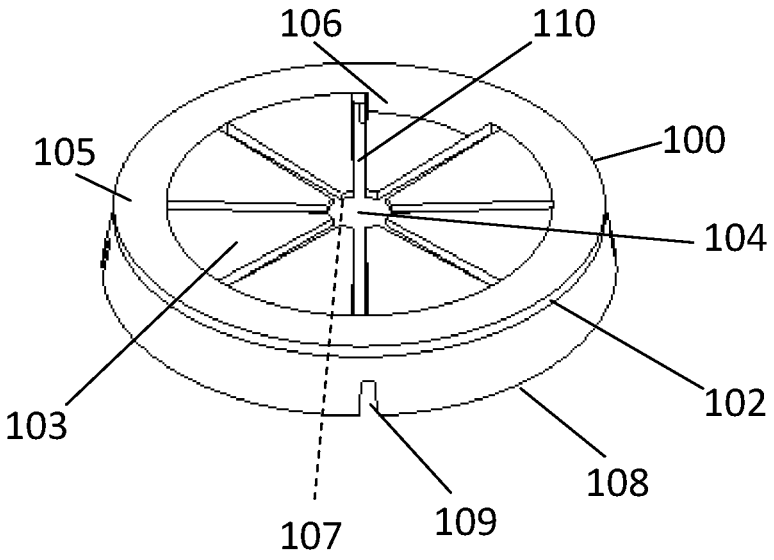
FIG. 5 is a perspective view of a first embodiment of my invention.
Figure 5A:
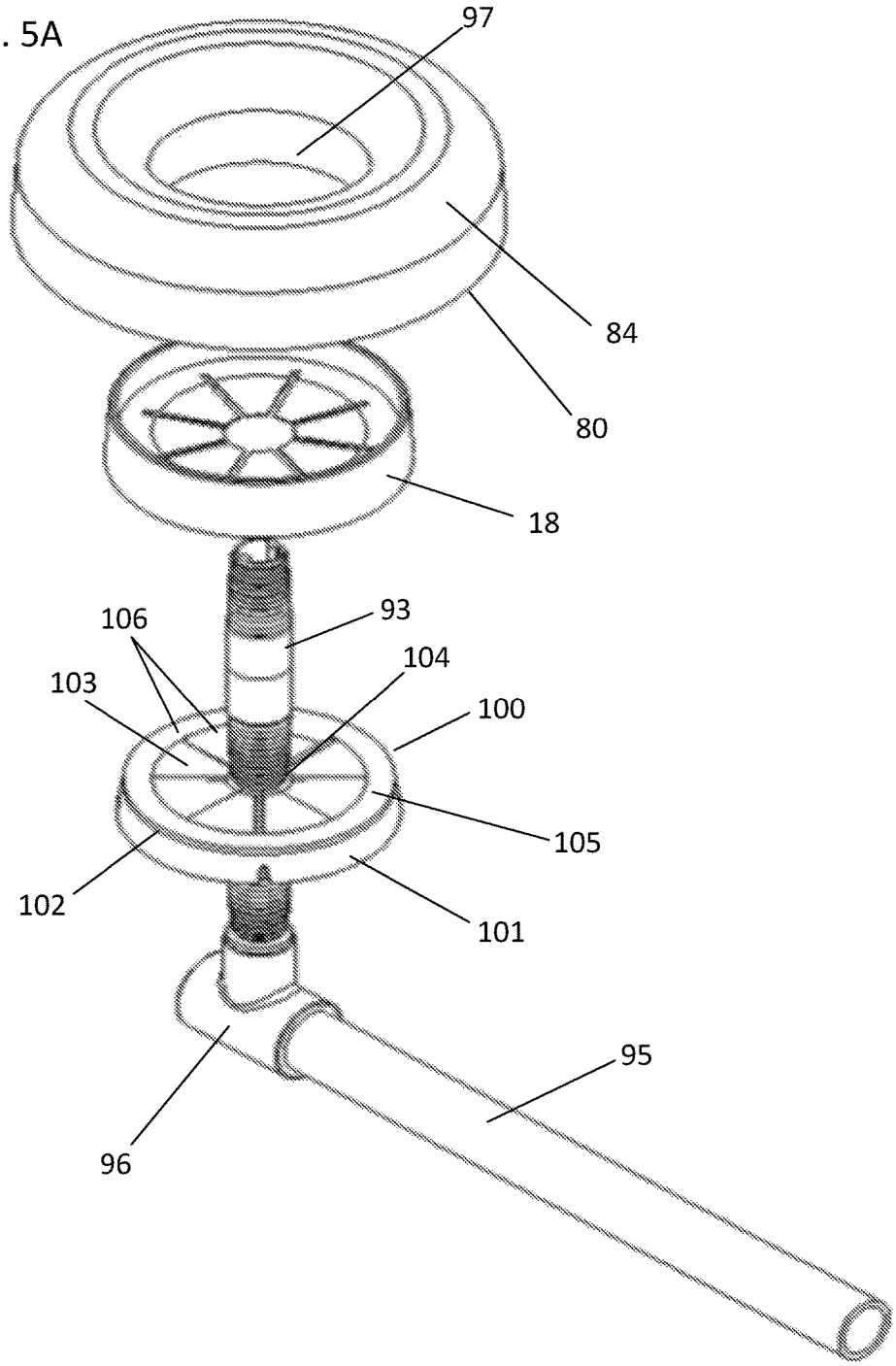
FIG. 5A is a perspective view of a first embodiment of my invention.
Figure 6:
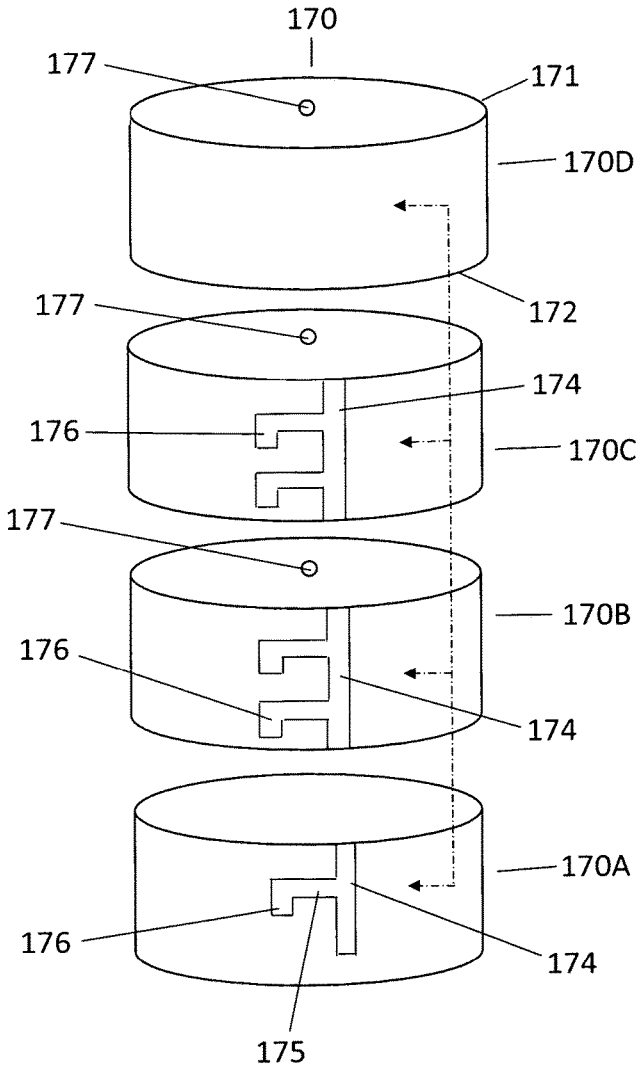
FIG. 6 is an expanded view of an alternative embodiment of my invention.

FIG. 1—accessible housing device—200, sprinkler assembly—140, water feed line—95, bottom connector—96, FIG. 1A—accessible housing device—200, sprinkler assembly—140, riser pipe—93, bottom connector—96, FIG. 2—housing Body—60, tubular cylinder—59, top section—61, bottom section—62, top rim—63, bottom rim—64, inner cavity—65, top outer surface area—67, cutouts—69, body wall—70, FIG. 3—housing cover—18, interior face—12, inner wall—13, bottom rim—14, exterior face—15, fingers—16, center opening—17, sidewall—19, slots—20, retaining lip—35, offset—49, FIGS. 4, 4A, 4B—safety cover—97, first outer edge of safety cover—98, center opening—99, top surface of donut—72 donut cavity—73, bottom rim of safety cover—74, support members—78, second outer edge of donut—79 bottom rim of donut—80 outer radius—81, inner radius—82, inner edge—83, donut—84, FIGS. 5, and 5A—offset insert—100, sidewall fins—101, outer edge—102, offset fingers—103, center opening—104, offset—105, exterior face—106, interior face—107, bottom rim—108, sidewall reliefs—109, slots—110, riser pipe—93, water feed line—95, bottom connector—96, FIG. 6—telescoping housing body—170, sections—170A, 170B, 170C, and 170D bottom rims—172 vertical grooves—174, horizontal grooves—175, locking grooves—176, nubs—177, top rims—171, FIG. 7—finger having an inner spring steel wire—130, wire—131, FIG. 7A—finger having a bottom surface rib—130A, back edge—132, FIG. 7B—finger having a knee joint—130B, FIG. 8—safety device—125 top surface—127 outer edge—128 donut lip—126 center opening—129, FIGS. 9 and 9A—safety cover and donut—112, outer radius—117, outer edge of donut—114, top surface—113, center opening—121, outer hollow cavity—115, support members—123, inner edge—119, center opening rim—118, outer edge—120, bottom rim of donut—116 inner radius—122, inner hollow cavity—127, FIG. 10—circular representational graph—46, FIG. 10A—housing body—60, vertical cutouts—69, driveway, and walkway—90, water feed line—95, bottom connector—96, FIG. 11—burlap material—94, FIG. 11A—covering sleeve—85,

DETAILED DESCRIPTION—FIRST EMBODIMENT

FIGS. 1 and 1A shows a perspective view and a detailed cutaway view of one version of a preferred first embodiment, illustrating an accessible housing device FIG. 1—200. The FIG. 1A is the detailed cutaway view of the accessible housing device—200. As can be seen in the FIGS. 1 and 1A, a pop-up sprinkler assembly FIG. 1—140, a riser pipe FIG. 1A—93, a portion of a water feed line FIG. 1—95, and a bottom connector FIG. 1A—96 are being housed by the accessible housing device—200. The housed devices in FIGS. 1 and 1A are easily accessed by removing a housing cover FIG. 1A—18, and a safety cover FIG. 1A—97. When the housing cover—18 and the safety cover—97 are removed, there is sufficient area around the housed devices for making a repair or a replacement.

FIG. 2 shows a perspective view of one version of a preferred first embodiment, illustrating the housing body FIG. 2—60. The housing body—60 is fabricated by a manufacturer using either an extrusion or an injection molding process. When manufactured the housing body—60 can comprise a height range of 6 to 18 inches. The housing body—60 forms a tubular cylinder FIG. 2—59 by having a top rim FIG. 2—63 and a bottom rim FIG. 2—64 joined to a top section FIG. 2—61, and a bottom section FIG. 2—62 of a body wall FIG. 2—70 respectively. An inner cavity FIG. 2—65 is comprised within the body wall—70. A plurality of cutouts FIG. 2—69 are comprised in the body wall—70 originating at the bottom rim—64 and extending upwards into the bottom section—62.

The cutouts—69, create openings in the body wall—70. I presently prefer that the housing body—60 be approximately 10 to 12" in height, and the cutouts—69 be approximately 4 to 4½" in height. In most cases the preferred foregoing dimensions are sufficient for housing the pop-up sprinkler assembly—140 and the immediate connectors—93, 95, and 96, and the height of the housing body—60 can be adjusted within a 4½" range via the cutouts—69. However, in other situations where the water feed line is positioned deeper than 12" a greater height of the housing body—60 would be needed, or where the water feed line is positioned much shallower, a shorter height of the housing body—60 would be needed.

The top rim—63 and a top outer surface area FIG. 2—67 of the top section—61, forms an upper top section of the housing body—60. The housing body—60 is comprised of a rigid material having a circular shape. I presently contemplate that the rigid material is a plastic. However other rigid and non-rigid materials such as metals, ceramics, harden clays, porcelains, fiberglass, rubber compositions, and the like would be suitable for forming the housing body—60. The housing body—60 could be formed from other shapes such as octagonal, pentagonal, hexagonal, square, triangular, and the like, or could comprise a combination of the foregoing shapes.

FIG. 3 shows a perspective view of one version of a preferred first embodiment, illustrating the housing cover FIG. 3—18. The housing cover—18 is fabricated by a manufacturer using an injection molding process.

DETAILED DESCRIPTION—FIRST EMBODIMENT

The housing cover—18 is formed by having an exterior face FIG. 3—15 and an interior face FIG. 3—12 extending outwards from a center opening FIG. 3—17 and joined to an inner surface of a sidewall FIG. 3—19. The interior face—12 is illustrated in (hidden projection lines in FIG. 3). The sidewall—19 extends circularly around the entire circumference of the exterior—15 and interior face—12. The exterior—15 and interior face—12 are positioned horizontally, and the sidewall—19 is positioned vertically. An offset FIG. 3—49 is comprised within the exterior—15 and interior face—12 originating at the sidewall—19. The offset—49 is vertically aligned in both the exterior—15 and interior face—12. A plurality of fingers FIG. 3—16 are comprised within the exterior—15 and interior face—12. The offset is position between the inner surface of the sidewall—19 and the fingers—16. The fingers—16 are joined to an inner area of the offset—49, and project inwards in adjacent angles and end at, and form the center opening—17 upon the termination. A plurality of slots FIG. 3—20 are comprised within the housing cover—18 and positioned between the fingers—16. The angled degree of the fingers—16, is proportional to their comprised number in combination with the width of the slots—20, eight of each are illustrated in FIG. 3. The angled range of the fingers—16 in combination with the slots—20 in the illustration of FIG. 3 is approximately from 40 to 45 degrees. A retaining lip FIG. 3—35 is joined to a top surface of the sidewall—19. The retaining lip—35 and the sidewall—19 align vertically, (best shown in FIG. 1A). The retaining lip—35 comprises an inner wall FIG. 3—13.

The housing cover—18 is comprised of a flexible material having a circular shape. I presently contemplate that the flexible material is a plastic. However other flexible materials such as rubber compositions or the like would be suitable for forming the housing cover—18. If the housing cover—18 comprised other shapes they would correlate with the shapes provided for the housing body—60 in combination or otherwise.

FIGS. 4, 4A, and 4B shows a perspective view, a 3-dimensional view, and a side view of one version of a preferred first embodiment, illustrating the safety cover FIGS. 4, 4A, and 4B—97. The safety cover—97 is fabricated by a manufacturer using an injection molding process. The safety cover—97 is formed by comprising a plurality of support members FIG. 4A—78 extending downwards forming a first outer edge FIG. 4—98 and joined to a back surface of an inner edge FIG. 4A—83, and a bottom surface of an inner radius FIG. 4A—82 of a donut FIG. 4—84, (best shown in FIG. 4A). The downward extension of the support members—78 forming the first outer edge—98 exceeds a downwards extension of a second outer edge FIG. 4B—79 of the donut—84. The first outer edge—98 is inwardly offset from the second outer edge—79 (best shown in FIG. 4B). The inner radius—82, extends gradually inwards and downwards from a top surface FIG. 4—72 forming a curved shape, and is joined to a top surface of the inner edge—83. An outer radius FIG. 4—81, extends gradually outwards and downwards from the top surface—72 forming a curved shape, and is joined to the top surface of the second outer edge—79. of the donut—84.

DETAILED DESCRIPTION—FIRST EMBODIMENT

The second outer edge—79 is joined to a bottom rim FIG. 4—80 of the donut—84. The inner surface of the inner edge—83 forms a center opening FIG. 4—99. The inner and outer surfaces of the inner edge—83 extend downwards and are joined to a bottom rim FIG. 4A—74 of the safety cover—97. The donut cavity FIG. 4A—73 originates at the inner surface of the second outer edge—79 and extends upwards occupying the bottom surface of the outer radius—81, the underside of the top surface—72, and a partial section of the bottom surface of the inner radius—82. The donut cavity—73 is illustrated in (hidden projection lines in FIG. 4A). The safety cover—97 is comprised of a rigid material having a circular shape. I presently contemplate that the rigid material is a plastic. However other rigid materials such as metals, ceramics, porcelains, harden clays, fiberglass, and the like would be suitable for forming the safety cover—97.

FIGS. 5 and 5A shows two perspective views of one version of a preferred first embodiment, illustrating the offset insert—100. The FIG. 5A illustrates the offset insert—100 in an expanded positional view, displaying the safety cover—97, the housing cover—18, and a rigid riser pipe—93 connected to a bottom fitting—96, that is connected to a water feed line—95. The offset insert—100 is fabricated by a manufacturer using an injection molding process. The offset insert—100 is formed by having an exterior face FIG. 5—106 and an interior face FIG. 5—107 extending outwards from a center opening FIG. 5—104 and forming an outer edge FIG. 5—102 upon a termination. The interior face—107 is illustrated in (hidden projection lines in FIG. 5). An offset FIG. 5—105 is comprised within the exterior—106 and interior face—107 originating at the outer edge—102. A plurality of offset fingers FIG. 5—103 are comprised within the exterior—106 and interior face—107.

The offset—105 is positioned between the outer edge—102 and the offset fingers—103. The offset—105 is vertically aligned in both of the exterior—106 and interior face—107. The offset fingers—103 are joined to an inner area of the offset—105 and project inwards in adjacent angles, and end at and form the center opening—104 upon the termination. A plurality of slots FIG. 5—110 are comprised within the offset insert—100 and positioned between the offset fingers—103. The angled degree of the offset fingers—103, is proportional to their comprised number in combination with the width of the slots—110, eight of each are illustrated in FIG. 5. The angle range of the offset fingers—103 in combination with the slots—103 in the illustration of FIG. 5 is approximately from 40 to 45 degrees. A plurality of sidewall fins FIG. 5—101 are comprised by the offset insert—100 aligning with the outer edge—102 and joined to the interior face—107. The sidewall fins—101 comprise a slight outward angle and extend downwards from the interior face—107 and are individually joined to a bottom rim FIG. 5—108. The sidewall fins—101 extends circularly around the entire circumference of the interior face—107 at the outer edge—102. A plurality of sidewall reliefs, are comprised by the offset insert—100 and positioned between the sidewall fins—101.

DETAILED DESCRIPTION—FIRST EMBODIMENT

The offset insert—100 is comprised of a flexible material having a circular shape. I presently contemplate that the flexible material is a plastic. However other flexible materials such as rubber compositions would be suitable for forming the offset insert—100. If the offset insert—100 comprised other shapes they would correlate with the inner cavity FIG. 2—65 of the housing body FIG. 2—60.

DETAILED OPERATION—FIRST EMBODIMENT

The accessible housing device FIG. 1—200 is installed in a residential, or a commercial lawn area, and is positioned around an existing pop-up sprinkler assembly FIG. 1—140 and the immediate connectors, FIGS. 1 and 1A—93 95 and —96. The accessible housing device—200 can also be installed in an initial installation of the pop-up sprinkler assembly—140, and the immediate connector—93 95 and 96.

The top rim FIG. 2—63 of the housing body FIG. 2—60 protrudes above a ground level at an approximated height of ¼" to ¾" after the installation is complete. This provides a benefit to a user of accessing the housed devices without the need for digging. The actual height of the top rim—63 above the ground level will be determined by the user. The accessible housing device—200 protects the housed devices from the surrounding elements and allows access to a human being for making a repair, and/or a replacement. The accessible housing device—200 saves its consumers both time, and labor when doing the repair, and/or the replacement. A hole is dug around the existing pop-up sprinkler assembly—140, revealing the pop-up sprinkler assembly—140, and the immediate connectors—93 95 and 96. In the present application, only a portion of the water feed line—95 is considered to be a part of the immediate connectors—93 95 and 96 so only an approximated 1 to 4" section directed outwards from the bottom connector—96 will be revealed. The housing body FIG. 2—60 is wrapped around the outer surface area of the bottom section FIG. 2—62 with a material such as burlap FIG. 11—94, plastic film, or the like, for diminishing the opportunity of any soil entering into the inner cavity—FIG. 2—65. The housing body—60 is lowered into the hole and centered using the existing pop-up sprinkler assembly—140. The height dimension of the housing body—60 is of sufficient size for housing the pop-up sprinkler assembly—140, the immediate connectors—93, 95, and 96. The inner cavity—65 is of sufficient size for housing the pop-up sprinkler assembly—140, and the immediate connectors—93 95 and 96. The housing body—60 is positioned where the cutouts—FIG. 2—69 are straddling the top of any incoming water feed line—95. The height and width dimensions of the cutouts—69, and their comprised number are of sufficient size, and amount for straddling multiple sized incoming water feed lines—95 simultaneously. The cutouts—69, constitute a means for straddling an outer body cover of multiple water feed lines—95, respectively.

The height of the cutouts—69 provides height adjustment for the housing body—60 during installation. The burlap material—94 is adjusted downward towards the bottom rim—64, for covering the cutouts—69 that are not in use, and any open areas in the cutouts—69 above the straddled water feed line or lines—95. The housing body—60 is back-filled with the dirt around the bottom section—62, and the top section FIG. 2—61 staying below the top outer surface area—FIG. 2—67. The top surface of the sprinkler assembly—140 should be level with or protrude at approximately ¼" to ½" above the top rim FIG. 2—63. The positional height of the pop-up sprinkler assembly—140 will be determined by the user. The dirt is tamped down to ensure that the housing body—60 maintains the installation position. The existing pop-up sprinkler assembly—140 is removed from the riser pipe—93. The housing cover FIG. 3—18 is placed on the top of the housing body—60 and pushed downwards until the interior face FIG. 3—12 is contacting the top rim—63, and the sidewall FIG. 3—19 is covering the top outer surface area—67. The inner diameter dimension of the sidewall—19 and the interior face—12 are of sufficient size for covering an upper top section of the housing body—60 (best shown in FIG. 1A). The housing cover—18 and the housing body—60 attach, and bind together via the downward push, but can be detached from one another by twisting the housing cover—18 in an upward motion. The pop-up sprinkler assembly—140 is inserted into the center opening FIG. 3—17 of the fingers FIG. 3—16 and re-connected to the riser pipe—93. The fingers—16 constitutes a first means for applying pressure against an outer body cover of the pop-up sprinkler assembly—140. The fingers—16, enclose and position the pop-up sprinkler assembly—140 having individually sized outer diameters by applying inward pressure. When the pop-up sprinkler assembly—140 is inserted into the fingers—16, they are pressed downward. The slots FIG. 3—20 provide individual flexibility for the fingers—16. The width dimension of the slots—20 is of sufficient size for allowing the fingers—16, to work individually or as a whole group.

DETAILED OPERATION—FIRST EMBODIMENT

The first outer edge FIG. 4—98 of the safety cover FIG. 4—97 is placed within the inner wall FIG. 3—13 of the retaining lip FIG. 3—35 of the housing cover—18. The user will grasp the second outer edge FIG. 4—79 of the donut FIG. 4—84 and align the first outer edge—98 with the inner wall—13 of the retaining lip—35 and push downwards until the first outer edge—98 bottoms out on the exterior face FIG. 3—15. The first outer edge—98 of the safety cover—97 is pressed fitted into the retaining lip—35 by hand. The safety cover—97 reduces open flexible areas around the pop-up sprinkler assembly—140, where it is enclosed by the fingers—16. The first outer edge—98 is of sufficient size for fitting snugly within the inner wall—13 of the retaining lip—35. The first outer edge—98 and the top outer surface area—67 of the housing body—60 are aligned vertically and correlate with one another dimensionally, (best shown in FIG. 1A—200). The foregoing correlations provide a solid foundation for the safety cover—97. The safety cover—97 reduces possible concerns of personal injury to persons inserting undesignated body parts into the exterior face—15 of the housing cover—18. The above body part could be a foot of a child or other persons. The safety cover—97 also protects the fingers—16 from direct exposure to the sun. The outer diameter dimension of the center opening FIG. 4—99 is of sufficient size for inserting various pop-up sprinkler assemblies—140 having individually sized outer diameters. The donut—84, constitutes a means for recognition identifying a location area of the accessible housing device—200 within a lawn area and provides extra protection to the pop-up sprinkler assembly—140.

The second outer edge—79 of the donut—84 extends further into the lawn area then the outer surface of the housing body—60. This further extension provides additional separation between the surrounding elements and the housed devices and could also provide additional foundation support for the safety cover—97. The additional foundation support is provided if the height of the housing body—60 is installed with the forethought of additionally supporting the safety cover—97 via the bottom rim. FIG. 4—80 of the donut—84. The height of the donut—84 and outer diameter dimension of the second outer edge—79 are of sufficient size for performing the above functions and benefits. An assembled accessible housing device and a detailed cutaway view are illustrated in FIGS. 1 and 1A—200.

In some situations, the housing body—60 may need to be offset; when the pop-up sprinkler assembly—140 is positioned adjacent to a driveway, and/or a walkway FIG. 10A—90. The offset will relocate the pop-up sprinkler assembly—140 approximately 1 to 4 inches from its original position. The installation of the housing body—60 in a situation that requires an offset is similar to the installation of the housing body—60 when an offset is not necessary. In accordance with the foregoing sentence, the installation instructions will not be duplicated where applicable in the forthcoming instructions. A hole is dug around the existing pop-up sprinkler assembly—140, as previously stated but is offset providing more of an opening in front of the assembly—140, and less behind the assembly—140, where the driveway, and/or walkway—90 are located. The FIG. 10A will be an instructional guide to the user for installing the housing body—60 when the offset is necessary. The housing body—60 in the drawing of FIG. 10A would be turned either clockwise or counter clockwise so that the cutouts—69, are straddling both of the incoming water feed lines—95 present. The FIG. 10—46 illustrates the approximate positions of the cutouts—69 after the turn has been performed. The width dimensions and the positional configurations of the cutouts—69 are of sufficient size and design for allowing the turn to be performed.

DETAILED OPERATION—FIRST EMBODIMENT

The illustration—10A shows the water feed line—95, and the bottom connector—96, as being positioned at the intersection of the driveway, and the walkway—90. The FIG. 10A is also a representation of the two devices—95 and 96, when they are positioned next to either the driveway, or the walkway—90, without the presence of the intersection. To envision this image, the reader need only mentally subtract the 90-degree angle of the intersection and extend the vertical and horizontal lines of the driveway and walkway—90 individually. When the housing body—60 is installed in a situation like FIG. 10A, the outer surface of the body wall—70 will not make direct contact with the hard surfaces—90 after the installation is accomplished. The bottom rim FIG. 3—14 of the sidewall FIG. 3—19 of the housing cover—18 after the attachment should not be hovering over the hard surfaces—90. The housing body—60 is wrapped around the outer surface of the bottom section FIG. 2—62 with a material such as burlap FIG. 12—94 for the reasons previously stated. The sprinkler assembly—140 is removed from the rigid riser pipe—93. The housing body—60 is lowered into the hole and is positioned where the rigid riser pipe—93, and/or the bottom connector—96 is within the inner cavity—65 of the body wall—70. At times the riser pipe—93 will be removed and one of the cutouts—69 will straddle the backside of the bottom connector—96 where the 90-degree elbow is comprised.

The housing body—60 will be turned circularly until the cutouts—69, are straddling the water feed line or lines—95 and moved in or out for allowing enough room for a proper attachment between the housing cover—18 and the housing body—60. The rigid riser pipe—93 is replaced by a flexible riser pipe and inserted into the offset insert FIG. 5—100, utilizing the center opening FIG. 5—104 of the offset fingers FIG. 5—103. The outer diameter dimension of the center opening—104 is smaller than the outer diameter dimension of the flexible riser pipe. The dimensions of the offset fingers—103 are of sufficient size for enclosing different sized flexible riser pipes. The offset fingers—103 constitutes a second means for applying pressure against an outer body cover of a flexible riser pipe.

When the flexible riser pipe is inserted into the offset fingers—103 they are pressed downward. The offset fingers—103, enclose and position the flexible riser pipe by applying inward pressure. The slots FIG. 5—110 separate and provide individual flexibility to the offset fingers—103. The width dimensions of the slots—110 are of sufficient size for allowing the offset fingers—103, work individually or as a whole group. The flexible riser pipe is connected to the bottom connector—96. The length of the flexible riser pipe varies so a portion will be coiled below the offset insert—100, and/or positioned within and outside the cutouts—69. The offset insert—100 is inserted and positioned within the inner cavity—65 of the housing body—60. The position of the offset insert—100 will be determined by the user, though being positioned slightly above the cutouts—69 works in most cases. The outer diameter dimension of the outer edge FIG. 5—102 is sized slightly smaller than the inner diameter dimension of the body wall—70 of the housing body—60, for permitting the insertion of the offset insert—100. The sidewall fins FIG. 5—101 should be projecting downwards when the offset insert—100 is inserted into the inner cavity—65. The sidewall reliefs FIGS. 5—109 divide the sidewall fins—101 into sections for providing flexibility. The sidewall reliefs—109, allow the sections of the sidewall fins—101 to be compressed inwards for working individually, or as a whole group.

The user will need to push the sections of the sidewall fins—101 inwards for insertion into the inner cavity—65 of the body wall—70. When the offset insert—100 is inserted into the inner cavity—65, the sidewall fins—101, correlate with the inner surface of the body wall—70. The slight outward angle of the sidewall fins—101 at the bottom rim FIG. 5—108, applies outward pressure against the inner surface of the body wall—70. The slight outward angle of the sidewall fins—101 is of a sufficient degree for applying the outward pressure against the inner surface of the body wall—70, and for maintaining the installation position of the offset insert—100. The offset insert—100 is utilized in the offset installation of the housing body—60, though can also be used when an offset is not necessary as illustrated in FIG. 5A. When the offset insert—100 is used in the above un-necessary application it would be for storage or for preventing loss, and not for functional reasons or purposes. The material wrapped around the bottom section—62 is adjusted downward for the reasons previously stated. The housing body—60 is stabilized, and the installation position is maintained by applying the back filling instructions as previously stated. The unconnected end of the flexible riser pipe is inserted through the interior face FIG. 3—12 of the housing cover FIG. 3—18, utilizing the center opening FIG. 3—17 of the fingers FIG. 3—16. The housing cover—18 is attached to the housing body—60 as previously stated. The flexible riser pipe is connected to the pop-up sprinkler assembly—140. The pop-up sprinkler assembly—140 is inserted into the fingers—16. When the sprinkler assembly—140 is inserted into the fingers—16, the offset insert—100 may be pushed downwards, though the distance will depend upon its initial installation position. The outer edge FIG. 4—98 of the safety cover FIG. 4—97 is installed within the inner wall FIG. 3—13 of the retaining lip FIG. 3—35 as previously stated. The above instructions can be adjusted as determined by the user. I am confident though, that an ordinarily skilled person in the art will be able to adjust the above instructions as determined in either installation situation and apply those adjustments to the accessible housing device—200 for installation purposes.

ALTERNATIVE EMBODIMENT

FIG. 6 shows an expanded view of an alternative embodiment of the housing body FIG. 1—60, illustrating a telescoping housing body FIG. 6—170. The telescoping housing body—170 is comprised of a predetermined number of sections four sections are illustrated in FIG. 6, and have the reference numerals—170A, 170, 170C, and 170D. The telescoping housing body—170 comprises a plurality of vertical grooves FIG. 6—174, a plurality of horizontal grooves FIG. 6—175, a plurality of locking grooves FIG. 6—176, and a plurality of nubs FIG. 6—177. The telescoping housing body—170 also comprises a plurality of top rims FIG. 6—171, and a plurality of bottom rims FIG. 6—172 positioned on the top and bottom areas of the sections 170A, 170, 170C, and 170D respectively. The three grooves 174, 175, and 176 are positioned on the outer surface of the sections 170A, 170B and 170C. The vertical grooves—174 extend upwards through top rims—171 and downwards through the bottom rims—172 in the sections—170B, and 170C. The vertical grooves—174 in the section—170A extends through the top rim—171 and terminates at a predetermined distance from the bottom rim—172. The top section—170D does not comprise the vertical groove—174, the horizontal grooves—175 or the locking grooves—176. The top section—170D comprises the sliding nubs—177. The horizontal grooves—175 stems off of the vertical grooves—174, and the locking grooves—176 stems off of the horizontal grooves—175. The sliding nubs—177, are positioned on an inner wall of the sections 170B 170C and 170D. The comprised number of sliding nubs—177 per section ranges from 2 to 4 one is illustrated in each applicable section in FIG. 6. The bottom section—170A does not comprise the sliding nubs—177. The sliding nubs—177, and the three grooves—174, 175, and 176, correlate in size, area, and design for operational purposes where applicable. The sections—170A, 170B, 170C, and 170D slid over one another for shelf convenience, and height adjustment as illustrated by the expanded projection lines in FIG. 6. The sliding nubs—177, are positioned within the vertical grooves—174 and can be moved upwards or downwards. The sliding nubs—177 are then slid into the horizontal grooves—175 and locked by the locking grooves—176 for height adjustment purposes. The telescoping housing body—170 could comprise a predetermined number of cutouts FIG. 2—69 (not shown).

In an alternative embodiment application, the telescoping housing body—170 could be a substitute for the housing body FIG. 2—60 of a first embodiment. The telescoping housing body—170 is comprised of a rigid material having a circular shape. I presently contemplate that the rigid material is a plastic. However, the telescoping housing body—170 could be comprised of various types of metals.

ALTERNATIVE EMBODIMENT

FIGS. 7, 7A, and 7B shows three perspective view of an alternative embodiment of the fingers—16, illustrating a finger having an inner spring steel wire FIG. 7—130, a wire FIG. 7—131, a finger having a bottom surface rib FIG. 7A—130A, a back-edge FIG. 7A—132, and a finger having a knee joint FIG. 7B—130B. The fingers—130, 130A, and 130B are fabricated by a manufacturer using an injection molding process. The finger having the inner spring steel wire—130 comprises a wire—131 of size sufficient for returning to a horizontal plane after being pressed downward. The wire—131 extends from out of the back edge and into the finger—130 terminating slightly short of the thinner end. In an alternative embodiment application, the wire—131 at the back edge would extend into a connection area such as the offset FIG. 3—49 for providing a stationary support base. The wire—131 and the stationary support base would be molded together by the manufacturing process. The wire—131 would run continuously through the inner area of both elements. The finger having a bottom surface rib—130A comprises a rib of sufficient size for having a resistance factor, and for returning to a horizontal plane after being press downward.

The rib on the bottom surface of finger—130A comprises a back edge—132. The back edge—132 of the rib within an alternative embodiment application would be in close proximity to an inner wall of the inner cavity FIG. 2—65. The back edge—132 would come into contact with the inner wall of the inner cavity—65 wall when it is pressed downward for providing an added resistance factor.

The finger having a knee joint—130B comprises a mixture of two plastics joined at the knee section. The top section of the finger of 130B would comprise a plastic that has less flexibility, than the plastic of the bottom section below the knee. The finger—130B encloses the pop-up sprinkler assembly—140 around the top cover area with the top section, and around the lower outer cover area with the bottom section. The fingers —130, 130A, and 130B are comprised of a flexible material, and could comprise other elements such as a flat thin flexible strip of metal, or have a spring molded into the bottom area, or a combination of the two.

ALTERNATIVE EMBODIMENT

FIG. 8 shows a perspective view of an alternative embodiment of the safety cover-FIG. 4—97, illustrating a safety device FIG. 8—125. The safety device—125 is fabricated by a manufacturer using an injection molding process. A donut lip FIG. 8—126 is position on an inner area of a top surface FIG. 8—127, and vertically aligns with a center opening FIG. 8—129. The top surface—127 extends outwards from outer side of the donut lip—126 and is joined to the outer edge—128. The safety device—125 donut lip 23 provides an alternative option to the user for acquiring a self-purchased donut available in today's market. The donut lip—126 does not permit movement, and/or sink-age of the self-purchased donut. The center opening of the self-purchased donut would be positioned on the top surface—127 straddling the donut lip—126.

In an alternative embodiment application, the safety device—125 could substitute the safety cover—97. The safety device—125 is comprised of a rigid material having a circular shape. I presently contemplate that the rigid material is a plastic. However other rigid materials such as metal, ceramics, porcelains or the like would be suitable for forming the safety device—125.

ALTERNATIVE EMBODIMENT

FIGS. 9 and 9A shows a perspective view and a detailed cutaway view of an alternative embodiment of the safety cover FIG. 4—97, illustrating a safety cover and donut FIGS. 9 and 9A—112. The safety cover and donut—112 is fabricated by a manufacturer using an injection molding process. The safety cover and donut—112 is substantially equivalent to the safety cover FIG. 4—97. The apparent difference between the two different embodiments is the inward length of the top surface FIG. 9—113 which creates a smaller center opening FIG. 9—121 the placement of an inner radius FIG. 9A—122, and the two hollow cavities FIG. 9A—115 and 127. The benefit of the safety cover and donut—112 in an alternative embodiment application, is the fact that additional areas within the housing cover FIG.

3—18, would be closed off for further reducing any liability concerns by the inward extension of the top surface—113. The plurality of support members FIG. 9A—123 extends downwards forming the outer edge FIG. 9A—120 and are joined to the back surface of the inner edge FIG. 9A—119, and to the outer surface of the inner radius—122 and have a curved shape in that area. The number for the support members—123 comprised within the safety cover and donut—112 ranges from 4 to 8, two are illustrated in FIG. 9A. The outer diameter of the outer edge—120 formed by the support members—123, could correlate with the inner wall FIG. 3—13 of the retaining lip FIG. 3—35 of the first embodiment. The safety cover and donut—112 could be housed within the inner wall—13 of the retaining lip—35. The inner radius—122 is joined to the top of the inner edge—119. The top of the inner radius—122 is joined to an underside of the top surface—113. The inner radius—122 directed towards the center opening—121 extends gradually upwards, and inwards forming a curved shape. The top surface—113 extends outward from the center opening—121 that comprises a center opening rim FIG. 9A—118 and is joined to the outer radius FIG. 9A—117. The outer radius—117 directed from the top surface—113 extends gradually outwards and downwards forming a curved shape and is joined to the outer edge FIG. 9A—114 of the donut part of—112. The outer edge—114 is joined to the bottom rim FIG. 9A—116 of the donut part of—112. The outer hollow cavity FIG. 9A—115 is positioned below the inner surface of the outer radius—117. The inner hollow cavity FIG. 9A—127 originates at the inner surface of the inner edge—119, and occupies the inner area of the inner radius—122, and the underside area of the top surface—113. The safety cover and donut—112 could be inserted into the inner wall—13 of the retaining lip—35, subsequently the top outer cover of the pop-up sprinkler assembly FIG. 1—140 would be enclosed under the top surface—113, and positioned within the inner hollow cavity—127. The pop-up portion of the sprinkler assembly—140 would rise through the center opening—121, for allowing normal spray of the pop-up sprinkler assembly—140. The safety cover and donut—112 is comprised of a rigid material having a circular shape. I presently contemplate that the rigid material is a plastic. However other rigid materials such as metals, ceramics, porcelains, harden clays, fiberglass, and the like would be suitable for forming the safety cover and donut—112.

ALTERNATIVE EMBODIMENT

FIG. 11A shows a perspective view of one version of an alternative embodiment of the burlap material FIG. 11—94, illustrating a covering sleeve FIG. 11A—85. The covering sleeve—85 is fabricated by a manufacturer using an extrusion or an injection molding process. The covering sleeve—85 could replace the burlap material FIG. 11—94 used in the operation sections of the first embodiment for covering the cutouts—69. The inner and outer diameter dimensions of the covering sleeve—85 could correlate with either the outer surface of the body wall FIG. 2—70 at the bottom section FIG. 2—62, or the inner surface of the body wall—70 at the bottom section—62 of the housing body—60. The covering sleeve—85 could be positioned around the outer surface of the body wall—70 at the bottom section—62 or inserted into the inner surface of the body wall—70 at the bottom section—62 during installation. The covering sleeve—85 could close off any open areas in the cutouts FIG. 2—69 of the housing body—60 where they are straddling the water feed lines—95 or where they are not in use. The covering sleeve—85 could be placed on top of any incoming water feed line—95, for diminishing the opportunity of any foreign substances entering into the inner cavity FIG. 2—65. The covering sleeve—85 is comprised of rigid material having a circular shape. I presently contemplate that the rigid material is a plastic. However other materials rigid or non-rigid such as metals, ceramics, porcelains, fiberglass, harden clays, rubber compositions, and the like would be suitable for forming the covering sleeve—85. The covering sleeve—85 could also comprise other shapes such as square, triangular, hexagonal, pentagonal or octagonal or the like including a combination of the foregoing shapes.

CONCLUSIONS, RAMIFICATION, AND SCOPE

Thus, the reader will see that at least one or more aspects, of one embodiment of the accessible housing device FIGS. 1 and 1A—200 provides sufficient size for housing a pop up sprinkler assembly FIG. 1—140, and the immediate connectors FIGS. 1 and 1A—93, —95, and —96, and for allowing access to a human being for making a repair, and/or a replacement; provides the access to the housed devices without the need for digging; provides multiple entrances for accommodating multiple water feed lines—95 simultaneously; provides enclosing, and positioning accommodations for various pop up sprinkler assemblies—140 having individually sized outer diameters, by applying inward pressure against their outer body covers; provides enclosing, and positioning accommodations for various flexible riser pipes, by applying inward pressure against their outer body covers in an offset installation situation; provides a safety feature having a recognition element, for reducing concerns of personal injury to children and other persons, and for identifying the location area of the accessible housing device—200 in a lawn area; provides a separation between the housed devices, and the surrounding elements, for diminishing operational problems; provides future savings for consumers in time, and labor, when doing the repair, and/or the replacement personally, and in cost when hiring a skilled artisan; provides a simple installation, and then after its appearance is uniform, attractive, and in plain sight for consumers, and lawn service providers; provides a more reliable accessible housing device—200, that is inexpensive to manufacture, and that greatly diminishes any consequential options, and/or limiting results for the end-user/purchaser.

While my above description contains many specificities, these should not be construed as limitations on the scope, but rather as an exemplification of one or several embodiments thereof. Many other variations are possible. For example, the accessible housing device—200 could be manufactured in various colors, such as green, black, or any other color pigmentation that a user believes is a complimenting addition to the surrounding lawn area.

The safety cover FIG. 4—97 could be replaced by other types of a safety feature such as expanded metal, or rigid plastic cages designed like the expanded metal, or they could have a mesh appearance such as a strainer with or without a center opening FIG. 4—99 and formed like a bowl or other shapes. The cages could be positioned outside and/or around the housing body FIG. 2—60 or be adapted to fit within the housing cover FIG. 3—18. The donut FIG. 4—84 of the safety cover—97 could comprise shapes such as various frogs, snakes, snails, in combination or in different action or still poses. The safety cover—97 could be adapted for comprising the fingers FIG. 3—16, which would eliminate the need for the housing cover—18. The safety cover—97 could be adapted for enclosing the top of the housing body—60 or could be changed entirely having its own body, circular or otherwise, and extending downward, and having the cutouts FIG. 2—69 or not, which would eliminate the need for the housing cover—18 and the housing body—60. The safety cover—97 could be eliminated though is comprised for providing a product comprising less possible liability concerns.

The offset insert, FIG. 5—100 could be replaced by other devices for enclosing and positioning the flexible riser pipe such as, flexible adjustable clips, and being attached in some manner to the inner surface of the housing body—60. The adjustable clips could also be attached to a sliding member with a type of locking element. The adjustable clips could be slid horizontally from right to left or vice-versa, and the flexible riser pipe would be snapped into the clips for enclosing and positioning purposes. The offset insert—100 could have a center type of spring hinge forming a type of V shape when un-inserted, and when inserted and pushed downwards in the center section it would become locked and form a horizontal plane. The offset insert—100 could be replaced by adjustable arms that are attached in some manner to the inner surface of the housing body—60, or that slide through the body wall FIG. 2—70 and have an adjustment means like a wire tie where one end is pulled for locking, and enclosing a group of wires, and thereby holding them in place and/or together.

CONCLUSIONS, RAMIFICATIONS, AND SCOPE

The offset insert—100 could be replaced by Styrofoam in sections or not, that would be inserted into the housing body—60 and formed so as to enclose and position the flexible riser pipe. The housing body—60 could be formed to replace the offset insert—100 having a section with a circular opening within the inner cavity FIG. 2—65 that extends inward and encloses and positions the flexible riser pipe. The offset insert—100 could be eliminated though is comprised for providing a product that can be installed in different situations.

The housing cover—18 could be attached to the housing body—60 in other ways such as by threads, or the two devices could comprise other methods like grooves and protrusions that snap in, and out of one another other or downwardly inserted into one another. The housing cover—18 could be adapted to fit inside the housing body—60 and have a threaded or binding means for attachment. The housing cover—18 and the housing body—60 could be manufactured as a single piece element, with the fingers—16 and FIG. 5—103 being molded inside the inner cavity—65. The housing body—60 could comprise a pressure means for enclosing the sprinkler assembly—140 such as flexible bands or sections of different materials that are bowed in and/or out at a center, and/or a top area, and have a connection or binding means within the inner cavity—65. The pressure means could be inserts comprising center openings that snap in, and out of a correlating connection element. The foregoing pressure means could be positioned within the inner cavity—65 or the housing cover—18. The foregoing connection element and insert could comprise interlocking threads or over-lapping sections that can be adjusted inwards and locked for adapting to the outer body cover of the pop-up sprinkler assembly—140. The housing body—60 could comprise a pressure means such as flexible clips positioned within the inner cavity—65 or within the housing cover—18 and the pop-up sprinkler assembly—140 would snap in and out of these clip devices. The housing body—60 could comprise a rim within the inner cavity—65 for housing an insert having fingers for applying pressure inward against the flexible riser pipe.

The fingers—16 could be comprised within an insert that connects in some manner to the housing cover—18. The fingers—16 and 103 could be manufactured so that they are angled either upwards or downwards or have a curved shape for correlating with the outer body cover of the pop-up sprinkler assembly—140. The fingers—16 and 103 could comprise other shapes such as square, triangular or be more pointed at their ends or overlap each other.

The housing body—60 could be manufactured without the cutouts FIG. 2—69 in this application the bottom rim FIG. 2—64 would be positioned on top of the incoming PVC water feed lines—95. The cutouts—69 could be eliminated completely, and the housing body—60 could be formed with the water feed line—95 extending somewhat out of the body wall—70 and connected to a bottom connector—96 that could also be connected to a riser pipe—93 within the inner cavity—65, and thereby forming a complete housing assembly—200 with or without the pop-up sprinkler assembly—140. The cutouts—69 could be designed having scored lines, or the housing body—60 could be thin enough so that its height could be adjusted by either snapping or cutting off the scored lines or the thin areas. The cutouts—69 could be concentric circular punch-outs so the user could determine the size and number needed for the incoming water feed line or lines—95. The foregoing application could be positioned in various areas of the housing body—60, and/or occupy a partial section of the bottom rim—64. The cutouts—69 could be comprised in another area of the housing body—60, such as somewhere above the bottom rim—64 leaving the bottom rim—64 intact. The cutouts—69 could have sharp bottom points or the like, for tapping the housing body—60 into the ground below the water feed lines. The cutouts—69 could be comprised of other shapes such as circular, square, triangular, hexagonal, octagonal, pentagonal, or rectangular. The cutouts—69 could be manufactured from a rigid material such as metal and be attached in various ways to the housing body—60.

CONCLUSIONS, RAMIFICATIONS, AND SCOPE

The vertical grooves FIG. 6—174, horizontal grooves FIG. 6—175, and locking grooves FIG. 6—176 and the sliding nubs FIG. 6—177 of an alternative embodiment could comprise other shapes or designs for adjusting the height of the telescoping housing body FIG. 6—170. The vertical grooves—174 could be replaced by an ascending or descending thread type grooves on each section, which would be turned in a circular motion and have a locking element for adjusting the height of the telescoping housing body—170. All of the above foregoing ramifications are to be applied in a mutual ownership where applicable, and further includes any variations of their like.

Accordingly, the scope should be determined not by the embodiments illustrated but by the appended claims, and their legal equivalents.

I claim:

1. A pop up sprinkler housing for seating over a pop up sprinkler assembly, said housing comprising:

a housing body having a sidewall with a top rim and a bottom rim, said bottom rim including openings extending upwardly from said bottom rim a distance such that said housing body can be seated over and straddle at least one water feed line located in said openings; said housing having an interior cavity that a human can reach into said housing and access a sprinkler located therein, without having to dig up the ground around the sprinkler;

a removable housing cover at the top of said housing, said housing cover having a perimeter sidewall having spaced top and bottom rims; said housing cover defining an opening and including a plurality of separate resiliently flexible fingers projecting inwardly from said sidewall in a plane located between said top and bottom rims; said perimeter sidewall above said fingers comprising a retainer lip for a safety cover, and said perimeter sidewall below said fingers defining a bottom lip for embracing said top rim of said housing; said resilient fingers extending inwardly to inner ends spaced from one another and leaving an opening between said inner ends of said fingers which is smaller than a circumferential dimension of the sprinkler assembly for which said housing is intended to be used, such that when said housing is seated over an upright pop up sprinkler assembly, said fingers engage, flex out of the way and resiliently press against the upright sprinkler assembly, whereby said housing can be positioned over pop up sprinklers having differing diameters;

a donut shaped safety cover having an inner wall defining a central opening for accommodating a pop up sprinkler projecting there through, an outer perimeter wall and a top wall joining said inner and outer walls, and interior structure between said inner and outer walls which seat within said retainer lip of said housing cover, whereby said safety cover covers said top rim of said housing cover, and is securely supported against shifting and canting with respect to said sprinkler housing and a sprinkler housed therein.

2. The pop-up sprinkler housing of claim 1 which is generally circular in cross section, having a diameter of 3½ to 5 inches.

3. The pop-up sprinkler housing of claim 2 which includes at least four of said openings extending upwardly from said bottom rim for embracing at least two crossing water feed lines.

4. The pop-up sprinkler housing of claim 3 in which said interior structure of said safety cover comprises a plurality of radially spaced projections which engage said retainer lip of said housing cover.

5. The pop-up sprinkler housing of claim 4 which includes a removeable insert positioned within said housing having a sloping perimeter wall which at its smallest lateral cross section is smaller than an interior circumferential dimension of said housing side wall, and at its largest lateral cross section is larger than the interior circumferential dimension of said housing sidewall whereby it can readily be forced into the interior cavity of said housing and will tend to stay in the position to which it is located; said insert being located below said housing cover and above said upwardly extending openings in said bottom rim of said housing; said insert including a plurality of separate resiliently flexible fingers projecting inwardly from said sidewall to inner ends spaced from one another and leaving an opening between said inner ends of said fingers which is smaller than the dimensions of the sprinkler assembly for which said housing is intended to be used; said fingers of said removable insert extending inwardly such that when said housing is seated over an upright pop up sprinkler assembly, said fingers engage, flex out of the way and resiliently press against said sprinkler assembly, whereby said housing can be positioned over pop up sprinklers having differing diameters.

6. The pop-up sprinkler housing of claim 5 in which said perimeter wall of said insert includes spaced slots which allow said perimeter wall to compress inwardly as it is inserted into said housing.

7. The pop-up sprinkler housing of claim 1 in which said interior structure of said safety cover comprises a plurality of radially spaced projections which engage said retainer lip of said housing cover.

8. The pop-up sprinkler housing of claim 1 which includes a removeable insert positioned within said housing having a sloping perimeter wall which at its smallest lateral cross section is smaller than an interior circumferential dimension of said housing side wall, and at its largest lateral cross section is larger than the interior circumferential dimension of said housing sidewall whereby it can readily be forced into the interior cavity of said housing and will tend to stay in the position to which it is located; said insert being located below said housing cover and above said upwardly extending openings in said bottom rim of said housing; said insert including a plurality of separate resiliently flexible fingers projecting inwardly from said sidewall to inner ends spaced from one another and leaving an opening between said inner ends of said fingers which is smaller than the dimensions of the sprinkler assembly for which said housing is intended to be used; said fingers of said removable insert extending inwardly such that when said housing is seated over an upright pop up sprinkler assembly, said fingers engage, flex out of the way and resiliently press against said sprinkler assembly, whereby said housing can be positioned over pop up sprinklers having differing diameters.

9. The pop-up sprinkler housing of claim 8 in which said perimeter wall of said insert includes spaced slots which allow said perimeter wall to compress inwardly as it is inserted into said housing.

10. The pop-up sprinkler housing of claim 1 which includes at least four of said openings extending upwardly from said bottom rim for embracing at least two crossing water teed lines.

* * * * *